United States Patent [19]

Bialkowski et al.

[11] 4,306,129

[45] Dec. 15, 1981

[54] LOW VOLTAGE CONTACTOR SWITCH WITH THREE-PHASE CONTACT BANK

[75] Inventors: Guenter Bialkowski; Gerhard Peche, both of Berlin, Fed. Rep. of Germany

[73] Assignee: Siemens Aktiengesellschaft, Berlin & Munich, Fed. Rep. of Germany

[21] Appl. No.: 145,708

[22] Filed: May 1, 1980

[30] Foreign Application Priority Data

Aug. 9, 1979 [DE] Fed. Rep. of Germany ..... 2932407

[51] Int. Cl.[3] ..... H01H 33/66

[52] U.S. Cl. ..... 200/144 B

[58] Field of Search ..... 200/144 B, 151, 147

[56] References Cited

U.S. PATENT DOCUMENTS

| | | | |
|---|---|---|---|
| 2,138,191 | 11/1938 | Noyes | 200/151 |
| 2,897,322 | 7/1959 | Reece | 200/144 B |
| 2,906,841 | 9/1959 | Jennings | 200/144 B |
| 2,979,587 | 4/1961 | Jennings | 200/144 B |
| 3,036,180 | 5/1962 | Greenwood | 200/144 B |
| 3,355,564 | 11/1967 | Ranheim | 200/144 B |
| 3,814,881 | 6/1974 | Cherry et al. | 200/144 B |
| 3,870,845 | 3/1975 | Clason | 200/144 B |

FOREIGN PATENT DOCUMENTS

| | | | |
|---|---|---|---|
| 1901067 | 10/1969 | Fed. Rep. of Germany | 200/144 B |
| 1262349 | 4/1961 | France | 200/144 B |
| 1372239 | 8/1964 | France | 200/144 B |

*Primary Examiner*—Robert S. Macon

*Attorney, Agent, or Firm*—Hill, Van Santen, Steadman, Chiara & Simpson

[57] ABSTRACT

A low voltage contactor switch has three simultaneously actuated pairs of contacts each of which consists of a movable and a fixed contact, with contacting occurring in a single evacuated area within a vacuum tube for minimizing oxidation of the contact surfaces and thereby increasing contact life. The contacts are connected to terminals which extend through walls of the vacuum tube in air tight fashion with actuation of the movable contacts being undertaken with the use of an air-sealed bellows. Each contact pair may be individually isolated by a cylinder within the evacuated area surrounding each contact pair as well as by a Y-shaped plate dividing the evacuated area into three chambers.

15 Claims, 2 Drawing Figures

LOW VOLTAGE CONTACTOR SWITCH WITH THREE-PHASE CONTACT BANK

BACKGROUND OF THE INVENTION

1. Field of the Invention

The present invention relates to low voltage contactor switches having a three phase contact bank and in particular to such a contactor in which contacting takes place in an evacuated tube.

2. Description of the Prior Art

Low voltage contactors capable of handling voltages of up to 1000 volts for operational switching of motors, capacitors and other electrical devices are well known in the art in which movable contact pieces make and break electrical connections in an air-filled arc chamber. The movable contact pieces of such contactors are generally activated by electromagnetic means. When such contactors are operated within the nominal voltage ranges, deterioration of the contact pieces occurs relatively rapidly due to oxidation caused by the arcing in an oxygen-containing atmosphere so that the contact pieces and arc chambers must be repeatedly replaced over the useful life of the entire contactor. Maintenance of such air gap contactors not only causes increased cost but also results in operational shutdown of the switched devices for the period during such maintenance, which may result in even greater expense.

SUMMARY OF THE INVENTION

It is an object of the present invention to provide a low voltage contactor switch having contact pieces with a life span which approximately coincides with the electromagnetic actuating means utilized with the contactor.

It is a further object of the present invention to provide such a contactor having a three phase contact bank with optimum isolation of the individual contact pairs to further prolong the useful life of the contactor.

The above objects are inventively achieved in a low voltage contactor switch having three pairs of movable and fixed contacts which are housed in a single vacuum switch tube with the three movable contact pieces being secured to the base of a single bellows for simultaneous actuation of the three movable contact pieces. The floor of the bellows is connected to a central drive tappet which is in turn connected to an appropriate actuating means. The bellows is also attached to one of two covers defining the vacuum switch tube within the contactor and the three fixed contact pieces are secured to the second cover of the vacuum switch tube.

By making and breaking electrical connections in a vacuum within the vacuum switch tube, oxidation of the contact pieces can be minimized so that such oxidation no longer plays a decisive role in determining the life span of the contactor. The life span of the contact pieces and of the bellows can be made to approximately coincide with the life span of the actuating means utilized to actuate the three movable contact pieces. Thus, even though the vacuum switch tube structure may initially be slightly more costly than conventional air gap contactor switches, the minimization of down time due to maintenance and the substantial elimination of replacement parts results in a low voltage contactor which is more economical and efficient over its expected life span than conventional air gap contactor switches.

Further advantages in contactor switches constructed according to the inventive concept disclosed herein can be derived by surrounding each contactor pair with a tubular insulator within the vacuum chamber to act as a vapor screen for isolating each contact pair. The bellows and the covers defining the vacuum area are free of electrical potential, so that no arcing is generated by those components. The cylindrical insulators need only be provided in the immediate area of contacting, thereby further saving on cost.

Further separation of the contact pairs can be achieved by inserting a Y-shaped plate within the vacuum housing to divide the housing into three sections each containing a contact pair.

The drive tappet for simultaneously actuating the movable contacts extends through the contactor wall in air tight fashion as do the terminal portions of the movable contact pieces.

The contactor housing and the bellows therein including the base of the bellows preferably consist of deepdrawn steel. The Y-shaped plate and the vapor screening cylinders within the vacuum area preferably consist of copper. The contact pieces, or at least the contacting faces thereof, preferably consist of an alloy of copper with tungsten or molybdenum or cobalt.

DESCRIPTION OF THE PREFERRED EMBODIMENTS

Figure 1:
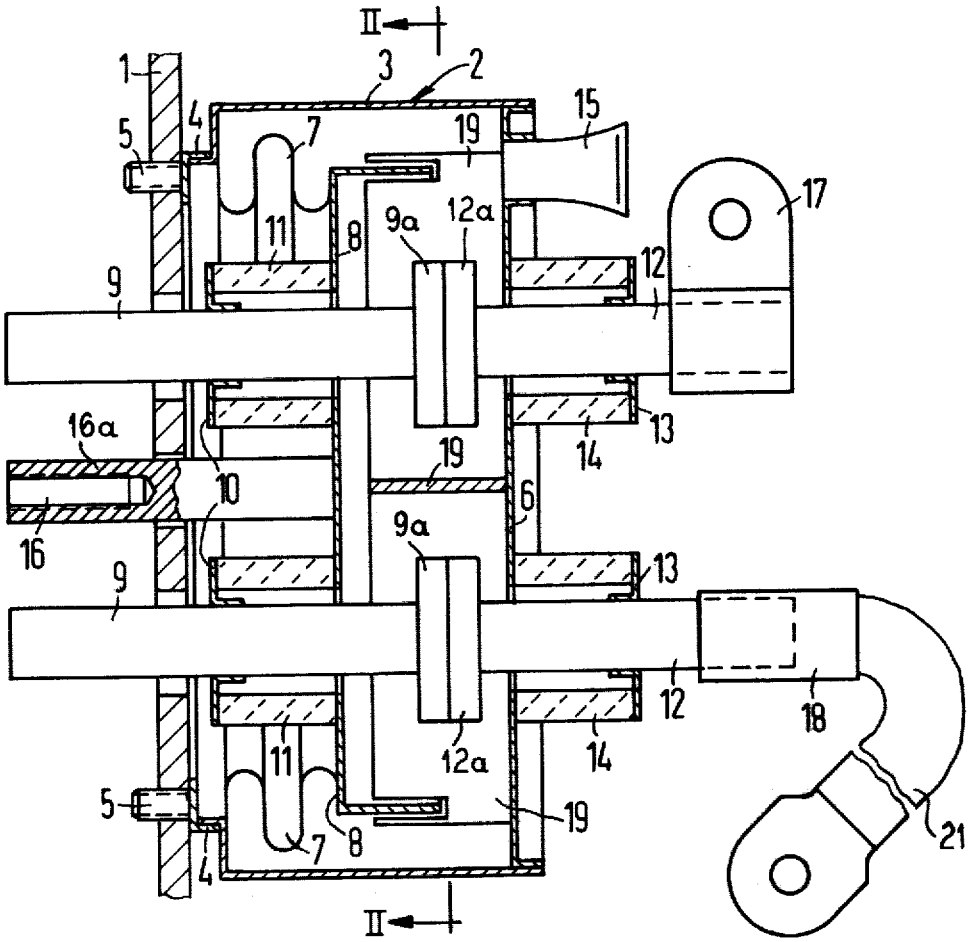
FIG. 1 is a sectional view of a low voltage contactor including a vacuum switch tube in which electrical contacting takes place constructed in accordance with the principles of the present invention.
Figure 2:
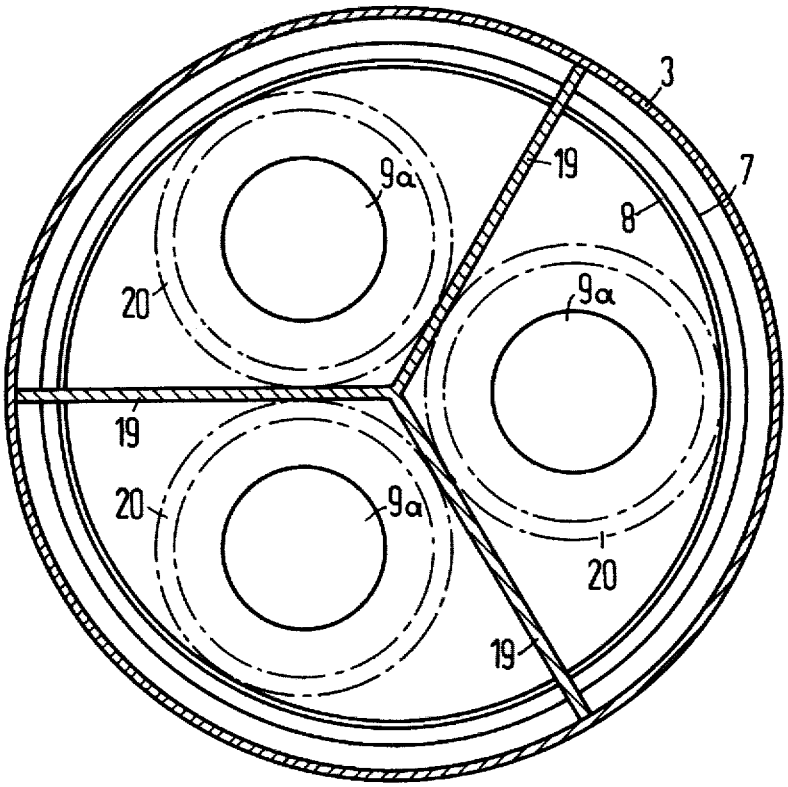
FIG. 2 is a sectional view taken along line II—II of FIG. 1.

A low voltage contactor switch having a three-phase contact bank is illustrated in section in FIG. 1. The contactor includes a supporting wall 1 to which a generally cylindrical contactor housing 2 is attached. The housing 2 consists of an annular cylindrical ring 3 which is attached to an annular flange 4 having three pins 5, two of which are shown in FIG. 2, which are inserted in corresponding receptacles in the wall 1 to affix the flange 4 thereto and hold the housing 2 in place thereon. The housing 2 is closed at an opposite side with a cover 6, applied in air tight relation to the cylindrical ring 3.

A bellows apparatus 7 is connected at one side to the flange 4 in air tight relation and is connected at an opposite side with a bellows base 8, also in air tight relation. An air tight discharge space within the housing 2 is thus formed which is defined by the bellows base 8, the cover 6, and the annular ring 3. The bellows base 8 forms a cup-like enclosure around the discharge space which serves as a lateral screen for vaporized contact material. The discharge area can be evacuated to form a vacuum therein through an evacuation nozzle 15 attached to the cover 6.

The bellows base 8 has three movable contacts 9, two of which are shown in FIG. 1, attached thereto by means of respective tubular insulators 11 respectively surrounding each of the contacts 9 and each of which terminates in a flange 10 which surrounds and engages the respective contacts 9 in air tight fashion. The bellows base 8 is further connected to a drive tappet 16 through a drive post **16*a* for connection to any suitable actuation device, such as an electromagnetic device. The contacts 9 and the drive post 16*a* each extend through corresponding openings in the wall 1. Suitable electrical connection can be made to each of the movable contacts 9** by any appropriate manner known to those skilled in the art.

Three fixed contacts 12, two of which are shown in FIG. 1, are mounted to the cover 6 by means of a tubular insulator 14 which terminates in a flange 13 which surrounds and engages the fixed contact 12 in air tight fashion. The fixed contacts 12 may terminate in any suitable electrical connection such as a clip 17 or a cable lug 18 for connection to a flexible cable 21.

Each movable contact 9 has a movable contact face 9*a* and each fixed contact 12 has a fixed contact face 12*a* which abut within the vacuum area defined by the bellows base 8, the cylindrical ring 3 and the cover 6 so that electrical making and breaking as a result of movement of the movable contact 9 and corresponding movement of the movable contact base 9*a* occurs in a substantially oxygen-free environment, thereby substantially eliminating oxidation due to arcing during contacting. Such operation greatly increases the life span of the contact faces 9*a* and 12*a*, thereby substantially eliminating the need to replace those faces and further eliminating the down time associated with such maintenance.

The entire bellows base 8 is movable by the drive tappet 16 so that simultaneous contacting of each of the movable contact faces 9*a* with a respective fixed contact face 12*a* occurs.

As best shown in FIG. 2, the three contact pairs are arranged within the housing 2 so that the center of each circular contact face essentially coincides with the corners of an equilateral triangle. The discharge area may be subdivided by a Y-shaped plate 19 for isolation of each contact pair to prevent passage of vaporized contact material among the contact pairs which might lead to a deterioration of effective electrical connection.

Each contact pair may be further isolated by a cylindrical vapor screen 20, shown in dashed lines in FIG. 2, individually surrounding each contact pair. The cylindrical vapor screens 20 may be used in combination with or in place of the Y-shaped plate 19.

By the employment of tubular insulators 11 and 14 as a means for supporting and sealing the respective contacts 9 and 12, the cost of manufacture of the contactor disclosed herein is maintained relatively low despite utilization of the somewhat expensive vacuum tube concept. The actuation stroke provided by the drive tappet 16 in the contactor is in the range of 1 to 5 mm, so that the bellows 7 is mechanically stressed to such a low degree that the bellows 7 exhibits a high life expectancy on the order of the useful life expectancy of the contacts, so that maintenance and down time for repair of the bellows 7 is not likely. Although any materials well known to those skilled in the art may advantageously be employed to construct the present inventions, the contact faces 9*a* and 12*a* may preferably be comprised of WCu, MoCu or CoCu. The vapor screening cylinders 20 and the screening plate 19 may be comprised of copper and the housing 2 and the bellows base 8 and bellows 7 may be comprised of deep-drawn steel.

Although modifications and changes may be suggested by those skilled in the art, it is the intention of the inventors to embody within the patent warranted hereon all changes and modifications as reasonably and properly come within the scope of their contribution to the art.

We claim as our invention:

1. A low voltage contactor switch comprising:

an evacuated housing;

three fixed contacts mounted inside said housing;

a bellows base;

a bellows interconnected between said bellows base and said housing in air-tight relation;

three movable contacts respectively mating with said three fixed contacts carried on said bellows base; and an actuator connected to said bellows base for simultaneously moving said base and said movable contacts, whereby electrical making and breaking of said fixed and movable contacts occurs in an evacuated environment for minimizing deterioration of said contacts.

2. The contactor switch of claim 1 wherein said fixed and movable contacts are respectively mounted on said housing and said bellows base by a tubular insulator surrounding each contact and attached thereto in air tight relation.

3. The contactor switch of claim 2 wherein said bellows and said housing are maintained competely free of electrical potential.

4. The contactor switch of claim 1 further including a plate attached to the interior of said housing dividing said interior into three chambers each containing a mating pair of fixed and movable contacts.

5. The contactor switch of claim 1 wherein said fixed and movable contacts are respectively arranged inside said housing and on said bellows base such that respective centers of each contact are disposed at corners of an equilateral triangle.

6. The contactor switch of claim 5 further including a Y-shaped plate disposed in the interior of said housing dividing said interior into three equal volume chambers each containing a fixed and a movable contact.

7. The contactor switch of claim 1 further including three vapor screening cylinders disposed in the interior of said housing, each said vapor screening cylinder surrounding a mating pair of fixed and movable contacts.

8. The contactor switch of claim 1 wherein said housing is comprised of an annular cylindrical ring and a pair of opposed covers attached to said ring in air-tight relation.

9. The contactor switch of claim 8 wherein one of said covers is secured to a supporting wall having at least one aperture therein and wherein said actuator extends through said supporting wall and is connected to an actuation means on the exterior of said housing.

10. The contactor switch of claim 8 wherein said supporting wall has an aperture in registry with each movable contact and wherein said movable contacts respectively extend through said apertures to the exterior of said housing.

11. The contactor switch of claim 1 wherein said housing, said bellows and said bellows base are comprised of deep-drawn steel.

12. The contactor switch of claim 4 wherein said plate if comprised of copper.

13. The contactor switch of claim 6 wherein said Y-shaped plate is comprised of copper.

14. The contactor switch of claim 7 wherein said vapor screening cylinders are comprised of copper.

15. The contactor switch of claim 1 wherein at least a mating portion of said fixed and movable contacts is comprised of material selected from the group of WCu, MOCu and CoCu.

* * * * *